US006092996A

United States Patent [19]

Obrist et al.

[11] Patent Number: 6,092,996

[45] Date of Patent: Jul. 25, 2000

[54] COMPRESSOR, PARTICULARLY FOR AN AIR CONDITIONING SYSTEM IN A MOTOR VEHICLE

[75] Inventors: Frank Obrist, Dornbirn, Austria; Jan Hinrichs, Friedrichsdorf, Germany; Hans-Jürgen Lauth, Anspach, Germany; Peter Kuhn, Weinheim, Germany

[73] Assignee: Luk Fahrzeug-Hydraulik GmbH & Co. KG, Germany

[21] Appl. No.: 09/033,841

[22] Filed: Mar. 3, 1998

[30] Foreign Application Priority Data

| | | | |
|---|---|---|---|
| Mar. 3, 1997 | [DE] | Germany | 197 08 517 |
| Mar. 3, 1997 | [DE] | Germany | 197 08 521 |
| Mar. 3, 1997 | [DE] | Germany | 197 08 504 |
| Mar. 3, 1997 | [DE] | Germany | 197 08 598 |
| Feb. 25, 1998 | [DE] | Germany | 198 07 691 |

[51] Int. Cl.[7] ..... F04B 27/08

[52] U.S. Cl. ..... 417/269; 92/71

[58] Field of Search ..... 417/269; 92/71

[56] References Cited

U.S. PATENT DOCUMENTS

| | | | |
|---|---|---|---|
| 4,526,522 | 7/1985 | Onoda | 418/63 |
| 4,820,133 | 4/1989 | Steele et al. | 417/269 |
| 4,846,635 | 7/1989 | Fry et al. | 417/410 |
| 4,872,814 | 10/1989 | Skinner et al. | 417/222 |
| 5,842,836 | 12/1998 | Tarutani et al. | 417/269 |

*Primary Examiner*—Timothy S. Thorpe
*Assistant Examiner*—David J. Torrente
*Attorney, Agent, or Firm*—Ostrolenk, Faber, Gerb & Soffen, LLP

[57] ABSTRACT

A compressor, particularly suited for use in the motor vehicle air conditioning system, having a compact and simple design. The housing is constructed of a body portion having a first wall area which defines the cavity containing the pumping unit and is designed to withstand the internal cavity pressure. A second wall area, not designed to withstand the internal cavity pressure, cooperates with a housing cover to seal the housing. The second wall area is under tension and is attached to the body by welding or by bending the second wall area. The cover includes a pair of pressure cavities separated by concentric annular sealing bridges. The sealing bridges have axially offset sealing surfaces which cooperate with a valve plate to seal off the two chambers. The sealing surface of the radially outer bridge may be formed of any elastic material. A drive-shaft and swash plate cooperate with a take-up plate to operate one or more pistons. A drive plate, integral with, or attached, as by welding, etc. to the compressor drive-shaft, is coupled to the swash plate. A projecting portion of the take-up plate having a first bearing surface is slidably connected to a support element.

28 Claims, 5 Drawing Sheets

COMPRESSOR, PARTICULARLY FOR AN AIR CONDITIONING SYSTEM IN A MOTOR VEHICLE

BACKGROUND OF THE INVENTION

1. Field of the Invention

The invention concerns a compressor, particularly for use in an air conditioning system in a motor vehicle.

2. Prior Art

Compressors of the type referred to here are well known. They are characterized by a pump unit enclosed in a housing. The housing is made up of several parts. As these are high pressure devices, to assure a reliable pressure seal, the parts of the housing are fitted with flanges and are screwed or bolted together. Because of the flanges, which stick out, conventional compressors are relatively large. It is also necessary to carefully select the material which comprises the flanges and screws or bolts to assure that the compressor functions safely under all conditions.

Generally, well-known air conditioning compressors in motor vehicles are designed as axial piston pump devices and are comprised of one or more pistons moving in a cylinder block, which draw the medium which is to be compressed from a suction chamber to a compression chamber. In order to do this the pistons reciprocate, this movement being effected by a swash plate rotating about an axis, in conjunction with a take-up plate, which is attached to the pistons. The take-up plate is fixed against rotation, typically by a thrust bearing attached to the compressor housing.

In such conventional compressors, the support for the take-up plate is quite complex, and the mechanism contains numerous different parts. In addition, the take-up plate is often weakened by the support mechanism.

Known compressors of this type also have the disadvantage that the attachment of the drive-shaft to the swash plate is achieved by means of pins or grouting. This means that a relatively large construction area is required.

In compressors of the type referred to here, one part of the housing serves as a cover for another part of the housing.

This lies on a specially designed sealing surface or sometimes on the cylinder block or on a valve plate of the device to draw the pressurized material. The cover has at least two sealing bridges, which are pointed towards the sealing surface and seal at least two pressure chambers from one another and from the environment. It has been found that it is not always possible to achieve the same level of surface compression at both sealing bridges, and that pressure can be lost if the component is elastically mishappen. i.e. if the cover portion becomes mishappen.

SUMMARY OF THE INVENTION

One object of the invention is to create a compressor, which is simply and compactly constructed, and which is characterized by particularly low levels of pressure loss.

A compressor according to this invention is characterized by the fact that it contains at least two parts of the housing, at least one of which parts contains a hollow cavity, in which the compressor is located. The first part of the housing has a first wall area of high strength selected to accommodate the pressure levels the inside of the housing. A second wall area in the first part of the housing is of reduced strength, but is not exposed to the pressure in the cavity. This serves to seal the housing without the need for further assembly parts. This results in a particularly compact construction which dispenses with the need for flanges and bolts or screws.

In one preferred embodiment, the housing is sealed by welding the two parts of the housing in the area of the reduced-strength wall area.

Prior to assembly and sealing, it is particularly advantageous to heat the second wall area to apply a longitudinal force. After assembly, this wall area remains in tension. This helps assure a reliable seal.

In another preferred embodiment, the housing is sealed by means of a bending process applied to the reduced-strength wall area. Again, this seals the housing directly and dispenses with the need for a flanged construction.

A second feature of the invention relates to the support mechanism for the take-up plate. According to this feature, a projecting portion of the take-up plate cooperates with a single support element. This reduces the number of parts to a minimum. The support element is characterized by a first sliding surface, which works in conjunction with a first bearing surface of the thrust bearing to support the take-up plate on the compressor housing. The projection and the support element are slidably connected to each other. This assures that the projection is held securely by the support element, and also allows the two parts to move relative to one another.

As an alternative, or an addition to the support mechanism described above, the driver and the compressor drive shaft are integral with, or attached, as by welding, soldering or gluing, to the swash plate. This eliminates the need for the swash plate to be attached around the drive-shaft, and results in a more compact design. It also allows the swash plate to swing further, so the compressor can be shorter.

A further feature of the compressor according to this invention is that the second part of the housing has a first sealing bridge that runs inside the perimeter on the side facing the sealing surface, which is in a first plane, and a second sealing bridge opposite the first which is directed outwards and situated in a second plane. The two planes are positioned relative to one another in such a way that when the housing is assembled, the first sealing bridge reaches the sealing surface before the second sealing bridge. This assures that the surface compression under the inner and outer sealing bridges is the same, even when the compressor is in operation, even if a component has been elastically mishapen when the housing was put together or when there is a high level of internal pressure in the compressor.

A further feature of this invention is that the inside of the second part of the housing is designed to be elastic, making it practically act as a spring element. This is particularly effective in guaranteeing that the surface pressure is the same, and therefore insuring optimum sealing.

DETAILED DESCRIPTION OF EMBODIMENTS OF THE INVENTION

Figure 1:
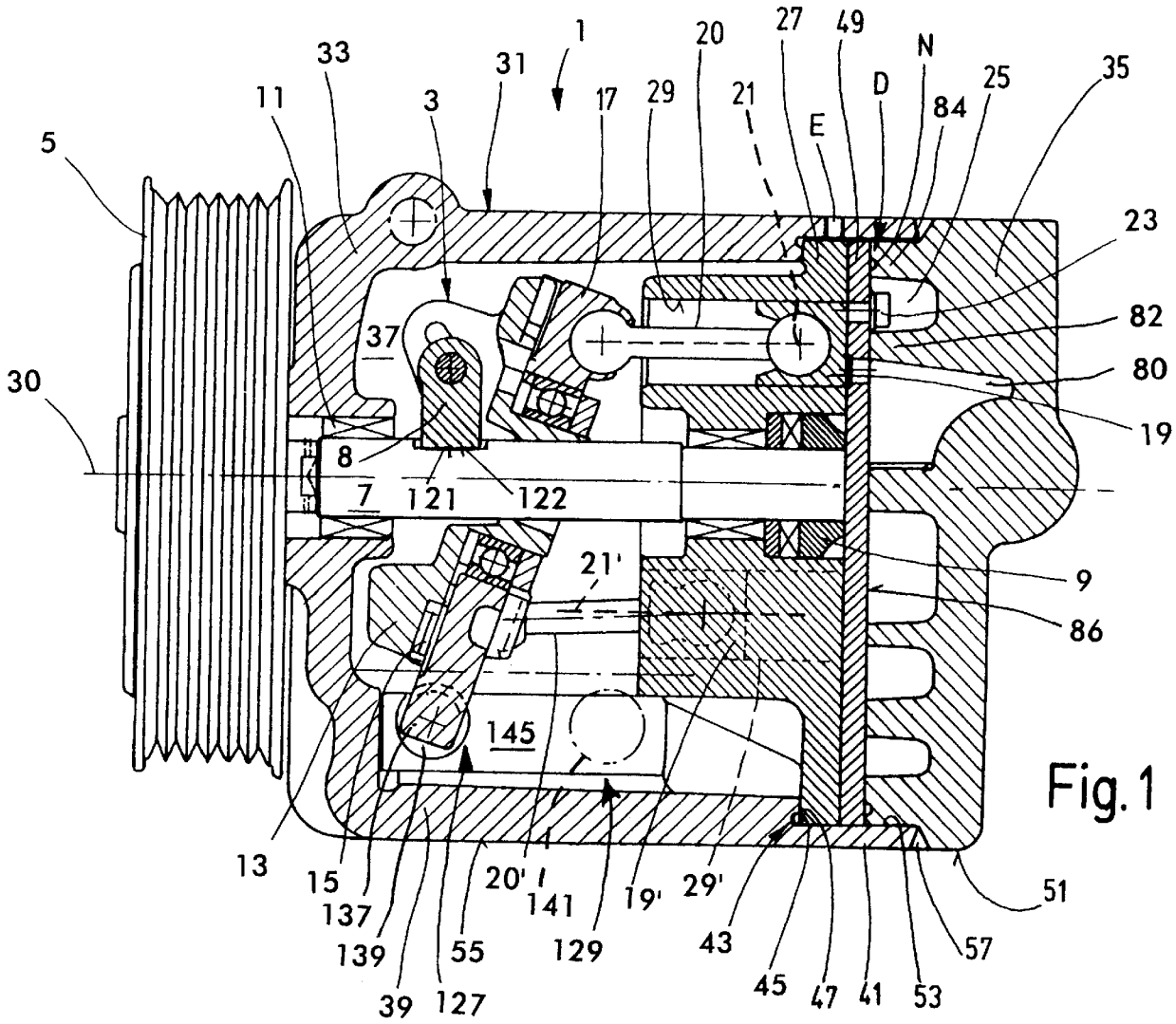
FIG. 1 shows a longitudinal section of a first embodiment in which the housing is welded.

Referring to FIG. 1, compressor 1 is shown in the form of an axial valve machine as the term is generally understood in the art, and is constructed and functions in a generally conventional manner. The compressor is driven in an appropriate way, for example by the motor vehicle's engine, by pulley 5 mounted on a drive-shaft 7. The end of drive-shaft 7 adjacent pulley 5 is supported by a floating bearing 11, and at the opposite end by a fixed bearing 9. Drive-shaft 7 is attached via a driving link 8 to a swash plate 13 so that it cannot rotate independently. A bearing device 15 couples swash plate 13 to a take-up plate 17.

At least one piston 19 is attached to take-up plate 17 by means of a connecting rod 20. In the embodiment shown, a second piston 19A is located underneath the first piston. The pistons are reciprocated by take-up plate 17 along the longitudinal axes 21. By means of a non-return valve arrangement 23, the piston draws the working fluid into high pressure chamber 25, from which is provided to the air conditioning system itself.

The pistons 19 and 19A are mounted in a cylinder block 27 which is characterized by bores 29 and 29A in which the pistons 19 and 19A travel. In the embodiment shown, the bores run essentially parallel to the center axis 30 of the compressor 3, which also represents the turning axis of the drive-shaft 7. Fixed bearing 9 is integrated into the cylinder block 27

Compressor 1 includes a housing 31, which, in the embodiment shown, is comprises of a first cylindrical part 33 and a second part 35. The first part 33 of housing 31 serves as the body of the compressor, and contains within its interior, cavity 37, pumping mechanism 3, including swash plate 13, take-up plate 17 and cylinder block 27. The second part of the housing 35 serves as a cover for the housing.

Housing body 33 includes a wall area 39, designed to withstand the pressure present in the inner cavity 37. Extending longitudinally from wall area 39 at the end opposite pulley 5 is a wall area 41. This is not exposed to high pressure present in cavity 37. To achieve this, the transition area between the wall areas 39 and 41 is equipped with a sealing device 43, which includes a groove located inside the perimeter 45 and an o-ring (not shown) which work in conjunction with a shoulder 47 of the cylinder block 27.

As can be seen from the longitudinal section represented in FIG. 1, the first wall area 39 is significantly thicker, and therefore stronger than the second wall area 41. The first wall area 39 is constructed in such a way that it can safely withstand the radial pressure exerted towards as well as the axial forces to which it is subjected.

The second wall area 41 extends beyond the cylinder block 27 and surrounds the shoulder 47. It also encompasses a valve plate 49, which lies flat against the cylinder block 27. The second wall area 41 extends beyond the valve plate 49 and covers a portion of housing cover 35. This serves to seal housing 31. Housing cover 35 has an indentation 53 on its perimeter surface 51, the depth of which corresponds to the thickness of the second wall area 41, so that the perimeter surface 51 is practically flush against outer surface 55 of housing body wall 39. The end of the second wall area 41 and the end of indentation 53 are beveled to form a v-shaped groove 57, which runs inside the perimeter in spaced relationship with the valve plate 49.

A sealing device D is located on the surface of housing cover 35 adjacent to valve plate 49. This is characterized by a nut N in which a sealing ring (not shown) is located. The sealing device D ensures that the pressure in the pressurized chamber 25 cannot reach the second wall area 41. The aim of this is to avoid pressure being exerted on this wall area radially and towards the outside. For reasons of safety, there is also a relief bore E by which any coolant which escapes under the second wall area 41 can pass out into the surrounding area. This further assures that the second wall area 41 cannot be impacted with excessive pressure, which could result in the build-up of force exerted towards the outside.

Figure 2:
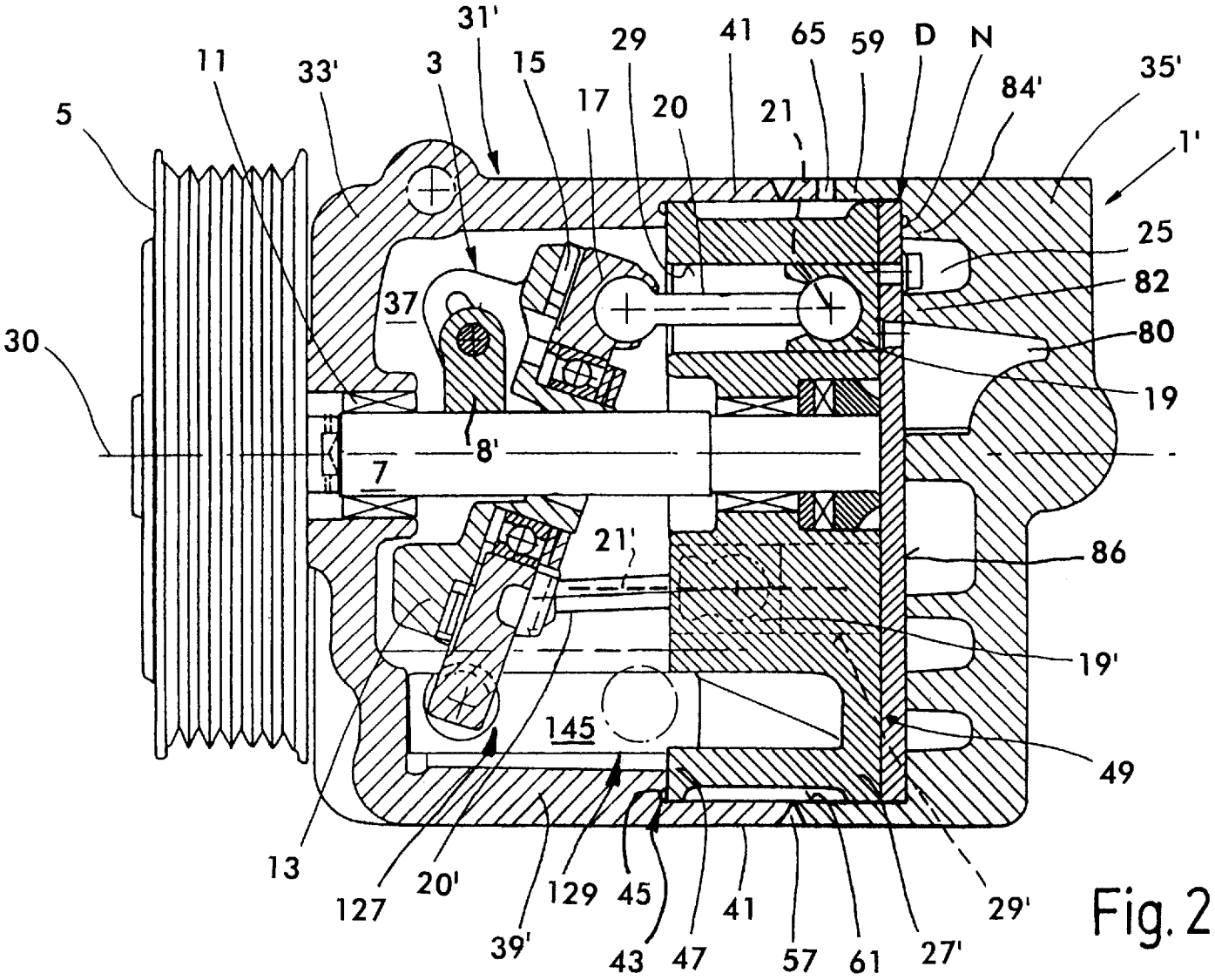
FIG. 2 shows a longitudinal section of a second embodiment having a welded housing.

FIG. 2 shows a modified embodiment of the compressor shown in FIG. 1. Here, compressor 1' includes a material pumping device 3', which is accommodated in cavity 37'. Pumping device 3' comprises a swash plate 13', a take-up plate 17' and a cylinder block 27'. The pumping device 3' is driven, via a pulley 5' and drive-shaft 7'.

The housing 31' includes body portion 33', which includes cavity 37'. This is smaller than that in compressor 1, as the cylinder block 27' includes a shoulder 47', which is further from the valve plate 49' than that of the cylinder block 27 of compressor 1. Thus the first wall area 39' of the housing body 33' is shorter than the first wall area 39 of compressor 1, measured from pulley 5. The first wall area 39' also has a sealing device 43' which ensures that the pressure in cavity 37' cannot be exerted on the second wall area 41' of housing body 33'. Therefore the second wall area 41' may be significantly weaker than the first wall area 39'. The latter must contain the entire pressure exerted outwards from cavity 37', while the second wall area 41' is not subjected to any outward pressure, and must only contain axial forces, i.e. in the direction of the turning axis 30'.

Housing cover 35' includes a section 59, which contains a hollow space 61. The valve plate 49' is located in this space. The cylinder block 27' also projects into hollow space 61.

The second wall area 41' and the wall section 59 are designed in such a way that they are flush with one another. They are also of the same thickness. Their front sides, which point towards each other, are beveled to form a v-shaped groove 57' which runs inside the perimeter. In the surface of housing cover 35' adjacent to valve plate 49', is a sealing device D', which can, for example, include a sealing ring (not shown) located in a groove N'. Sealing device D' ensures that the excessive pressure in the area of the second part of the housing, for example, in the pressurized chamber 25', cannot be exerted on section wall 59.

Wall section 59 and the second wall area 41' completely cover the area of cylinder block 27'. Hollow space 61 is located radially inward relative to v-shaped groove 57'. Hollow space 61 is connected to the surrounding area by means of a relief bore 65. If there is a leak of the pressure within the compressor 1' through the sealing device, and the pressure reaches the second wall area 41' or the wall section 59, this pressure is reduced by means of the relief bore 65. This makes it impossible for the second wall area 41' and the wall section 59 to be impacted with excessive pressure which could result in the build-up of force exerted towards the outside.

In the embodiment shown in FIG. 1, the housing is sealed by welding housing body 35 to housing cover 35 within the area of the v-shaped groove 57. In this way, the two parts of housing 33 are securely connected together, and can effectively contain axial forces without any additional means of connection. The housing of compressor 1' shown in FIG. 2 is also sealed by welding the parts together in groove 57'.

As a consequence of the construction described, the housing body 33 and cover 35 (and correspondingly body 33' and cover 35') are pressed tightly against one another in an axial direction, which assures effective operation of sealing devices 43 and D and 43' and D'. Also, this assures that thinner wall portions 41 and 41' do not have to resist high pressure, but only axial forces.

Before welding, it is possible to warm the second wall area 41 (see FIG. 1) or 59 (see FIG. 2) in order to stretch them longitudinally. Then the parts of the housing are welded together, and a secure connection is made. If, subsequently, the thinner-walled areas contract there still will be a high level of built-up axial forces, which ensures a pressure-tight seal of the sealing devices 43 and D, and 43' and D'.

In order to connect the parts of the housing, a laser welding process, for instance, can be used. In this case the v-shaped groove is not required. However, other processes can also be used. Thus, whether the housing is made of steel, or even aluminum, it can be much smaller than is possible when external flanges and bolted connections are employed. Cavity 37 may also be smaller.

Figure 3:
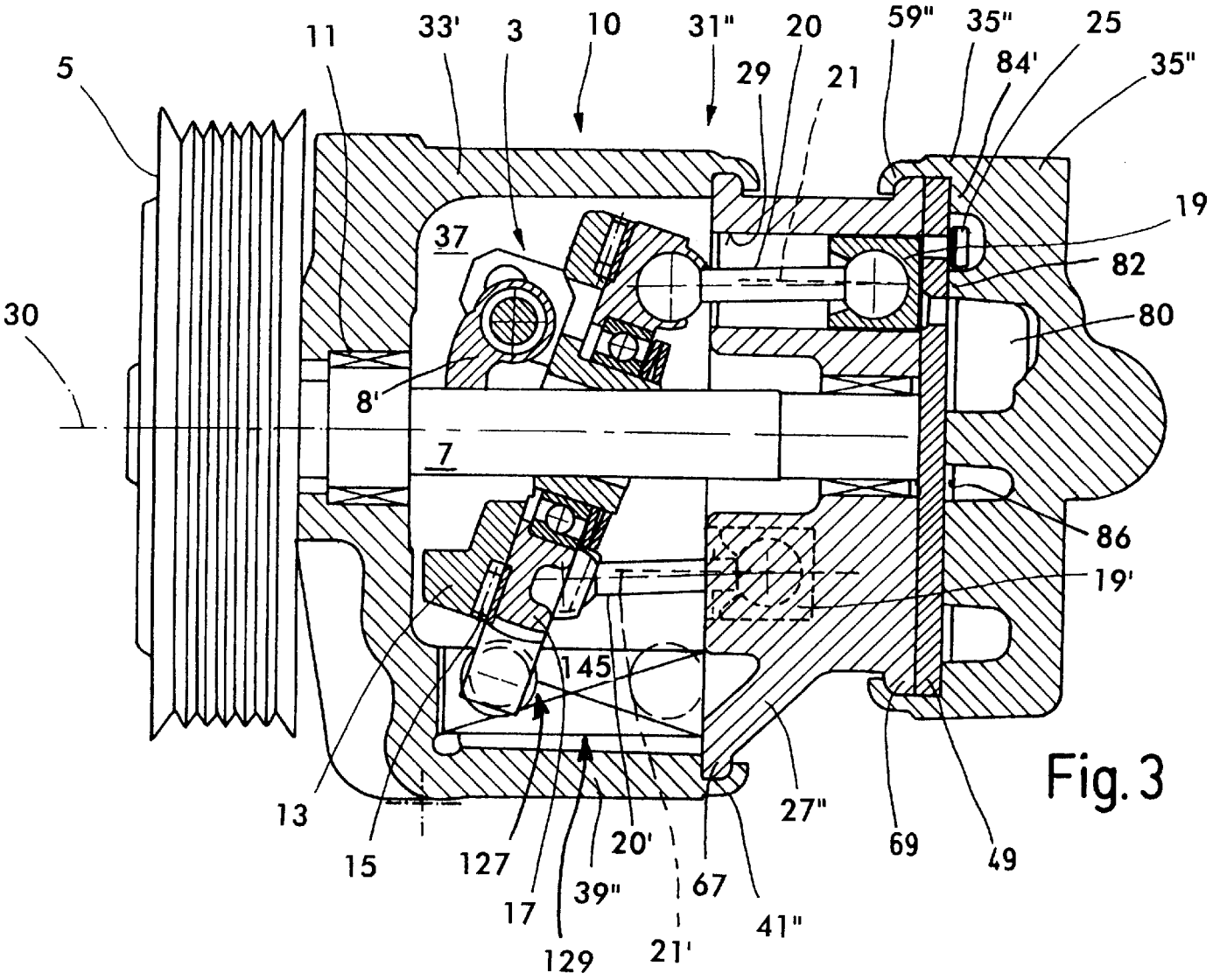
FIG. 3 shows a longitudinal section of a third embodiment in with the housing is manufactured using a reshaping process.

The basic principle of the direct connection between the parts of the housing is also realized in a further embodiment shown in longitudinal section in FIG. 3. Here, compressor 10 is comprised of a housing 31", having a body portion 33" which contains pumping device 3", including swash plate 13", a take-up plate 17" and cylinder block 27". The cavity 37" inside the housing body 33" is so small that it only includes the swash plate 13" and the take-up plate 17", as is also the case for compressor 1', shown in FIG. 2. As in the previous embodiments, the compressor is driven by means of a pulley 5" and a drive-shaft 7".

Housing body 33" has a first wall area 39" that is thick enough to resist the working pressure inside cavity 37". A second wall area 41", which is significantly thinner, and which is not exposed to the internal pressure, extends axially from first wall area 39". The first wall area 39" lies against the cylinder block 27", forming a seal. A sealing device can be fitted here, as described from FIGS. 1 and 2. The second wall area 41" is bent around a corner 67 of the cylinder block 27", to seal cavity 37".

On the side of the cylinder block 27" which is opposite the cavity 37", is positioned a valve plate 49". This is held in place against cylinder block 27" by means of a flange 59" which extends axially from cover 35" beyond the valve plate 49" to a shoulder 69 on cylinder block 27". Housing cover 35" is secured to the cylinder block 27" by bending flange 59" around shoulder 69. A sealing device (not shown) can also be inserted here, if desired.

In this embodiment, the housing 31" of compressor 10 may be thought of as having three/parts, the first being housing body 33", the second being housing cover 35" and the third being cylinder block 27". By the bending process described, the housing body 33" and cover 35" are connected to cylinder block 27" so that the system is pressure-tight and a complete housing 31" for the compressor 10 is formed. The second wall area 41" and the wall section 59" are not subject to the internal pressure, and exclusively absorb axial force. Since the bending process, creates a pressure-tight seal without using additional assembly elements, compressor 10 is also very small and light weight.

The embodiment represented in FIG. 1 is characterized by a take-up plate 17, which is connected to a swash plate 13 by a bearing device 15. The take-up plate 17 is arranged in the housing 31 so that it cannot turn and is supported by means of a support mechanism on a thrust bearing 129 which is positioned in the housing 31 so that it cannot rotate. The thrust bearing 129 is characterized by two bearing surfaces, of which one bearing surface 145 is illustrated. The embodiments of FIGS. 2 and 3 are similarly constructed.

Still referring to FIG. 1, rotation of drive-shaft 7 by means of the pulley causes swash plate 13 to rotate. Take-up plate 17, which is supported on a thrust bearing 129 which cannot rotate. The take-up plate 17 together with the swash plate 13, moves in a rolling fashion, so that connecting rods 20 and 20A cause pistons 19 and 19A reciprocate within bores 29 and 29A.

Still referring to FIG. 1, take-up plate 17 includes a projection 137, which forms part of the support mechanism 127 and which works in conjunction with a support element 139. The thickness of the projection 137 corresponds to that of the take-up plate 17, giving a particularly high level of security between the two surfaces. The support element 139 contains a sliding surface, which slides along the bearing surface 145 of thrust bearing 129. In the representation in FIG. 1, the support element 139 is as far left as it will go. A dotted circle indicates the farthest right position of the support element 139 which should also indicate where in its cycle the swash plate 13 would be in at this point. In the position shown here, upper piston 19 is in its top possible position in the cylinder block, while the lower piston 19A is practically in its bottom possible position.

Figure 4:
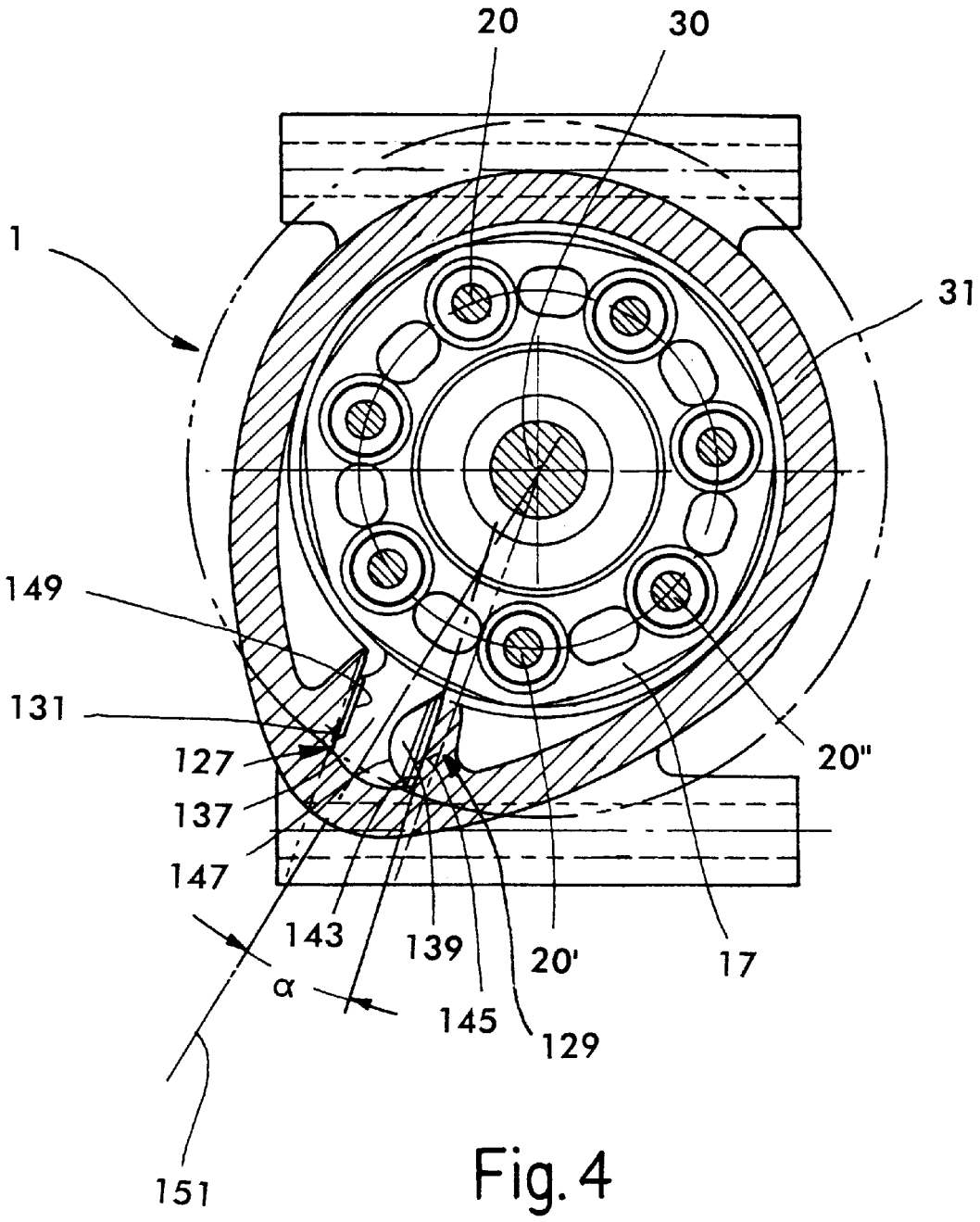
FIG. 4 shows a cross section of the embodiment of FIG. 1.

FIG. 4 shows a cross-section of the compressor 1 shown in FIG. 1. Parts which are the same are indicated with the same reference numbers.

It can be seen from the cross-section representation that the compressor comprises seven connecting rods 20, 20A, 20B, etc. which point in the same direction and are equidistant from one another. It can also be seen that the take-up plate 17 continues into a projection 137, which forms part of the support mechanism 127. The projection 137 is integral with the take-up plate 17, and works in conjunction with the support element 139, which, by means of a first sliding surface 143, slides along one bearing surface 145 of the thrust bearing 129. The projection 137 and the support element 139 are fitted together. In the area in which they make contact there is a second sliding surface 147, which has a curved, preferably spherical projection which engages a corresponding cavity in projection 137.

This permits support element 139 to be carried along when the projection 137 reciprocates and eliminates need for additional safety elements in order to connect the two parts of the support mechanism 127.

Still referring to FIG. 4 on the side of the projection 137 opposite to support element 139 is a third sliding surface 149, which works in conjunction with the bearing surface 135 of thrust bearing 129 (see FIG. 1). From FIG. 4, it can be seen that the first bearing surface 131 and the second bearing surface 145 of the thrust bearing 129 run largely in parallel to one another. It is also possible for these surfaces to intersect to form a pointed corner which opens in the direction of the take-up plate 17.

FIG. 4 also shows that the bearing surfaces form an angle with an imaginary line 151 passing through rotational axis 30. The angle of this corner is approximately 12°. However, it is also possible to arrange the bearing surfaces so that they are parallel to the radially extending line 151.

Figure 5:
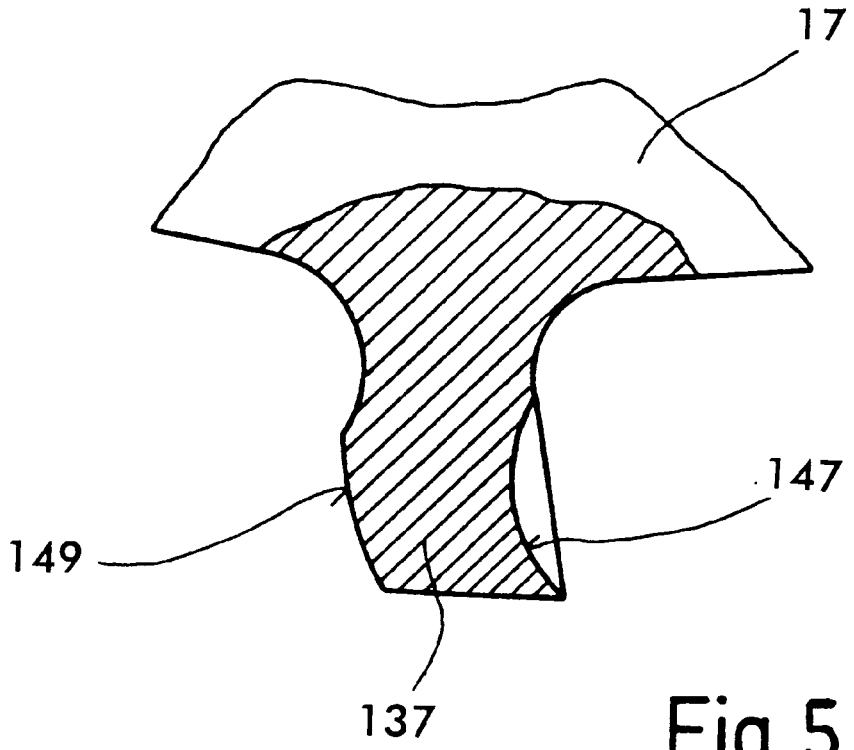
FIG. 5 shows a detailed, enlarged longitudinal section of a modified version of the support mechanism.

FIG. 5 shows the projection 137 on support mechanism 127 in a modified form. This is characterized by the fact that its third sliding surface 149 is not straight, but bent. It is thus possible to enable a tipping, or swinging motion of the projection 137 relative to the first bearing surface 131.

Figure 6:
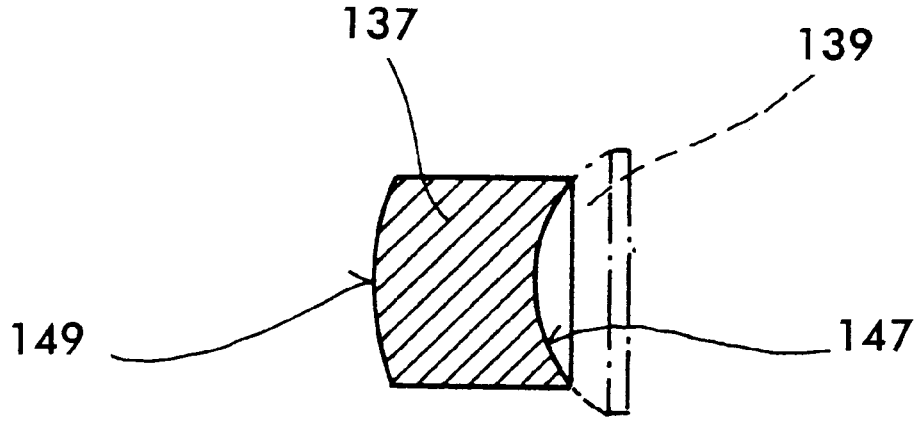
FIG. 6 shows a detailed, enlarged cross-section of a further modified version of the support mechanism

In a further variation shown in FIG. 6, not only is sliding surface 149 bent, but it is also curved vertically. This allows a swinging motion perpendicular to the vertical plane of the drawing. It will also be understood that the upper curved portion 149A in FIG. 5 may be eliminated, if desired.

In all the embodiments discussed above, surfaces 131 and 145 and/or the sliding surfaces 143, 147 and 149 are characterized by a hard, i.e., wear resistant surfaces. This may be achieved by applying a wear resistant layer to bearing surfaces 131 and 145. This is particularly advantageous if the compressor housing is made of a relatively soft material, such as aluminum. The wear resistant layer may advantageously be a welding alloy, and it is particularly beneficial to coat the first sliding surface 143 of the support element 139 with such a material. Alternatively, support element 139 may be made of a wear resistant material, such as steel, or the housing may be formed of aluminum-containing silicon, so that the bearing surfaces are naturally wear resistant. In those cases, the bearing surface does not need to be coated.

The construction of the third sliding surface 149 shown in FIGS. 5 and 6 may be used in the construction of FIG. 4, in which the bearing surfaces of the thrust bearing 129 are at an angle to radial line 151, and also in conjunction with a thrust bearing whose bearing surfaces run in parallel to the line 151.

A compressor built in accordance with this invention allows optimal support of the take-up plate 17 on thrust bearing 129. Bearing 129 may be in the form of a thrust washer 129 formed integral with the housing 31 (see FIG. 4) to provide a simple, cost-effective construction.

It should be noted that sliding surface 147 can be curved in the opposite direction from that shown to provide a spherical convex curvature on projection 137, which fits into a support element which has a corresponding recess.

It should also be noted that in the illustrated embodiments, projection 137 is supported on the second bearing surface 145, by means of the support element 139 only when swash plate 13 rotates in a counterclockwise direction. If the compressor is intended to rotate in the opposite direction, the support mechanism must be built as a mirror image.

Referring again to FIG. 1, there is shown a particularly advantageous connection between drive-shaft 7 and swash plate 13. As illustrated, drive plate 8 fits into a groove 121 running parallel to the rotational axis 30 of drive-shaft 7. The groove 121 preferably has a flat base 122 and, for example, is formed by milling the perimeter surface of the drive-shaft 7. The drive 8 can be connected to the drive-shaft 7 by welding, friction welding, gluing, soldering or similar processes. Alternatively, as illustrated in FIGS. 2 and 3, it is also possible to make the drive-shaft and the driver as a single integral unit. Either construction is considerably more compact than a construction in which drive plate 8 is connected to drive-shaft 7 by means of bolts or pins. Drive plate 8 may also be adjustably positioned in the axial direction on drive-shaft 7. The compact design allows swash plate 13 to swing out further, decreasing the overall size of the compressor compared to conventional designs.

Referring again to FIG. 1, high pressure chamber 25 in housing cover 35 is largely formed in the shape of an annulus extending around the interior of the housing cover. A second annular chamber 80, which forms the input pressure chamber is concentric with the first chamber 25, and offset radially inward.

High pressure chambers 25 and 80 are sealed off from one another by means of a first sealing bridge 82. A second sealing bridge 84 seals the first pressurized chamber 25 off from the atmosphere. The second sealing bridge 84 is fitted with a first sealing mechanism D, such as an o-ring N mounted in an annular groove on the inner face of cover 35. First sealing bridge 82 may have similar a seal (not shown) if desired.

The sealing bridges 82 and 84 rest on the outer surface 86 of valve plate 49 which effectively serves as a sealing surface for housing cover 35 and housing body 33. The surfaces of sealing bridges 82 and 84 which engage with the sealing surface 86 of valve plate 49 are slightly axially offset so that when the housing cover 35 is assembled, sealing bridge 82 makes contact with sealing surface 86 slightly ahead of the second sealing bridge 84. The offset is between 0.04 mm to 0.12 mm, but preferably between 0.06 mm and 0.10 mm. An optimum offset would be 0.08 mm. This construction provides a very effective pressure seal between cover 35 and body 33, irrespective of how the two parts of the housing 33 and 35 are connected to one another. In fact, even if conventional methods such as bolted flanges are used to connect the two parts of the housing, axially offset sealing bridges may advantageously be employed.

One particularly advantageous variation is to form the second sealing bridge 84, of a resilient material. This construction can produce a very effective given high output pressures typically found in compressors of this kind compressor 1, (commonly in the range of 80 bar to 120 bar, or even as high as 200 bar).

In summary then, compressors constructed in accordance with the present invention are both simpler are more compact in construction than conventional compressors. In the embodiments of FIGS. 1 and 2, this is brought about in part because the portion of the housing body which engages with the housing cover is not exposed to the high pressure in the main cavity, and in all embodiments, by the employment of the two sealing bridges having axially offset sealing surfaces. This also balances out any distortion of the housing cover which can result from high pressure in the pressurized chambers, and thus there is practically no loss of pressure. The compact construction is also contributed to by the manner in which the driver plate is coupled to the drive-shaft, or by providing the two as an integral element, and by constructing the support mechanism for the take-up plate with a projection having a first sliding surface, which works in conjunction with one surface of the thrust bearing, and a second sliding surface cooperates with a surface of the support member.

Although the present invention has been described in relation to particular embodiments thereof, other variations and modifications and other uses will be apparent to those skilled in the art in light at of the description. It is intended, therefore, that the present invention be limited not by the specific disclosure herein, but only by the appended claims.

What is claimed is:

1. A compressor for a motor vehicle air conditioning system comprising:

a housing including a body and a cover;

the body defining a cavity containing a compressor mechanism;

the body including a first wall area, the strength of which is sufficient to resist the pressure in the cavity; the body further including a second wall area, adjacent to the first wall area, and so located that it is not directly exposed to the internal pressure in the cavity;

the strength of the second wall area being significantly less than that of the first wall area;

the second wall area being in tension and cooperating with the housing cover to seal the housing.

2. A compressor as described in claim 1, in which the housing body and cover are welded together.

3. A compressor as described in claim 2, in which the second wall area of the housing body at least partially overlies the housing cover, and in which the second wall area is welded to the housing cover.

4. A compressor as described in claim 1, in which the housing cover includes an extending wall section which abuts the second wall area of the housing body.

5. A compressor as described in claim 1, further including a sealing mechanism which shields the extending wall section from the pressure inside the housing.

6. A compressor as described in claim 1, in which the extending wall section of the housing cover is welded to the second wall area of the housing body.

7. A compressor as described in claim 1, including a relief bore through which working fluid, which escapes from the compressor cavity may be vented to the atmosphere.

8. A compressor as described in claim 1, in which the housing cover is sealed to the housing body by a bending process.

9. A compressor is described in claim 8, in which the housing cover includes an axially extending wall area and in which the housing is sealed by bending the ends of the second wall area of the housing body and the axially extending wall area of the housing cover.

10. A compressor as described in claim 8, in which the housing cover further includes an intermediate element to which the housing body is secured by bending.

11. A compressor as described in claim 10, in which the housing cover includes an axially extending wall section; in which the intermediate element includes axially spaced, radially extending, shoulders; and in which the ends of the second wall area of the housing body and the axially extending wall section of the housing cover are bent around the shoulders of the intermediate element.

12. A compressor as defined in claim 1, further including:

a swash plate rotating about a turning axis;

a drive-shaft adapted to be connected to a source of power;

a drive plate connecting the drive-shaft to the swash plate;

a cylinder block;

at least one piston located in the cylinder block;

a take-up plate, including a support mechanism coupled to the swash plate, which reciprocates the piston as the swash plate rotates;

a thrust bearing having a bearing surface;

a projection extending from the take-up plate;

a support element including first and second sliding surfaces;

the first sliding surface of the support element engaging with the bearing surface of the thrust bearing and the second sliding surface of the support element engaging with the projection extending from the take-up plate.

13. A compressor as defined in claim 12, in which the drive plate is integral with the drive-shaft.

14. A compressor as described in claim 12, in which the projection extending from the take-up plate has a hollow, and in which projection extending from the support element fits into the hollow.

15. A compressor as described claim 12, in which the support element is formed as a spherical section.

16. A compressor as described in claim 12, in which the thrust bearing has a second bearing surface which works in conjunction with the projection extending from the take-up plate.

17. A compressor as described in claim 16, in which the projection extending from the take-up plate has a third sliding surface which engages with the second bearing surface of the thrust bearing.

18. A compressor as described in claim 17, in which the third sliding surface is curved in two planes.

19. A compressor as described in claim 12, in which the thrust bearing includes a second bearing surface, and in which at least one of the bearing surfaces is covered with a wear-resistant coating.

20. A compressor as described in claim 12, in which the thrust bearing includes a second bearing surface, and in which the first and second bearing surfaces extend essentially parallel to one another.

21. A compressor as described in claim 12, in which the thrust bearing includes a second bearing surface, and in which the first and second bearing surfaces form an acute angle with one another.

22. A compressor as described in claim 1, in which the housing cover includes:

first and second pressurized chambers;

a first sealing bridge between the first and second pressurized chambers;

a second sealing bridge between the second pressurized chamber and the outside of the housing cover; and and further including a sealing member positioned in the cavity in the housing;

the sealing member including a sealing surface which cooperates with the housing cover;

the first and second sealing bridges including planar sealing surfaces which are in parallel, axially offset relationship to each other such that when the housing is assembled, the sealing surface the first sealing bridge engages with the sealing surface of the sealing member before the sealing surface of the second sealing bridge.

23. A compressor as described in claim 22, in which the second sealing bridge is resilient relative to the sealing member.

24. A compressor as described in claim 22, in which the housing cover is made of a relatively resilient material.

25. A compressor as described in claim 22, including a flexible seal positioned to cooperate with one of the sealing bridges and the sealing member.

26. A compressor as described in claim 22, in which the axial offset between the sealing surfaces of the sealing bridges is between approximately 0.04 mm and 0.12 mm.

27. A compressor as described in claim 23, in which the axial offset between the sealing surfaces of the sealing bridges is between approximately 0.06 mm and 0.10 mm.

28. A compressor as described in claim 22, in which the axial offset between the sealing surfaces of the sealing bridges is approximately 0.08 mm.

* * * * *